US006637961B1

(12) United States Patent
Adkins et al.

(10) Patent No.: US 6,637,961 B1
(45) Date of Patent: Oct. 28, 2003

(54) ENCODER CONTROL SYSTEM FOR PRINTERS AND RELATED METHODS

(75) Inventors: Christopher Alan Adkins, Lexington, KY (US); Lucas David Barkley, Lexington, KY (US); Hugh Edwin Gilbert, Versailles, KY (US); Michael Anthony Marra, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/897,470

(22) Filed: Jul. 2, 2001

(51) Int. Cl.[7] ..... B41J 29/18
(52) U.S. Cl. ..... 400/708
(58) Field of Search ..... 400/708; 250/205, 250/231.16, 201.1, 206, 214 LS; 324/175, 166, 160

(56) References Cited

U.S. PATENT DOCUMENTS 4,074,128 A 2/1978 Harris, Jr. et al.
4,137,451 A 1/1979 Einolf, Jr.
4,374,384 A 2/1983 Moates
4,455,562 A 6/1984 Dolan et al.
4,563,747 A 1/1986 Tidd
4,596,995 A 6/1986 Yamakawa et al.
4,727,428 A 2/1988 Futatsugi et al.
4,835,551 A 5/1989 Ng
4,837,587 A 6/1989 Ng
5,051,579 A 9/1991 Tsukiji et al.
5,124,732 A 6/1992 Manzer et al.
5,235,175 A 8/1993 Mayer
5,302,944 A 4/1994 Curtis
5,406,267 A 4/1995 Curtis
5,424,535 A 6/1995 Albion et al.
5,586,055 A 12/1996 Ng et al.
5,809,216 A 9/1998 Ng

*Primary Examiner*—Raquel Yvette Gordon
(74) *Attorney, Agent, or Firm*—Thompson Hine LLP; Scott N. Barker; Jacqueline M. Daspit

(57) ABSTRACT

An analog encoder system repeatedly switches back and forth between monitoring of first and second encoder output signals to track movement of a structure associated with the encoder. An energization level of an encoder light element may be controlled in accordance with which encoder output signal is being monitored.

27 Claims, 6 Drawing Sheets

ENCODER CONTROL SYSTEM FOR PRINTERS AND RELATED METHODS

TECHNICAL FIELD

The present invention relates generally to encoder systems used for tracking movement of mechanical structures and, more particularly, to an analog encoder control system and related method which facilitates achieving more desirable encoder output signals.

BACKGROUND OF THE INVENTION

Presently known analog encoder systems are often expensive due to the nature of the design, particularly due to the cost in manufacturing an encoder which will produce ideal analog output signals. Less expensive analog encoder systems, such as those using an encoder mask which is external to the photo sensors, may produce distorted analog output signals. For example, where the ideal analog output signals are triangle waves, less expensive encoder systems may instead produce more sinusoidal output signals which lack linearity throughout the entire signal.

Different encoder channels typically have different output levels for the same light intensity due to differences in components on the photo sensor side of the encoder. In the past, in order to attempt to produce encoder signals having matching characteristics, gain control circuitry has been used on the photo sensor side of the encoder. However, such gain control circuitry can be expensive.

It would be advantageous to provide an encoder system in which the cost and complexity of the gain control circuitry on the photo sensor side of the encoder is reduced or eliminated.

SUMMARY OF THE INVENTION

In one aspect, a method for tracking movement of a structure using first and second encoder output signals involves: (a) monitoring only one of the first and second encoder output signals at a time; (b) during monitoring of the first encoder output signal, energizing an encoder light element at a first energization level; and (c) during monitoring of the second encoder output signal, energizing the encoder light element at a second energization level which is different than the first energization level.

In another aspect, a method for tracking movement of a structure using first and second encoder output signals involves: (a) monitoring only one of the first and second encoder output signals at a time; (b) storing first and second energization levels for use in energizing an encoder light element; (c) during monitoring of the first encoder output signal, energizing the encoder light element according to the first stored energization level; and (d) during monitoring of the second encoder output signal, energizing the encoder light element according to the second stored energization level.

In yet another aspect, a method is provided for controlling an encoder in a position tracking system in which first and second encoder output signals are produced by an encoder and only one of the first and second encoder output signals is monitored at any given time. The method involves: (a) during monitoring of the first encoder output signal, energizing an encoder light element at a first energization level; and (b) during monitoring of the second encoder output signal, energizing the encoder light element at a second energization level which is different than the first energization level.

DETAILED DESCRIPTION

Figure 1:
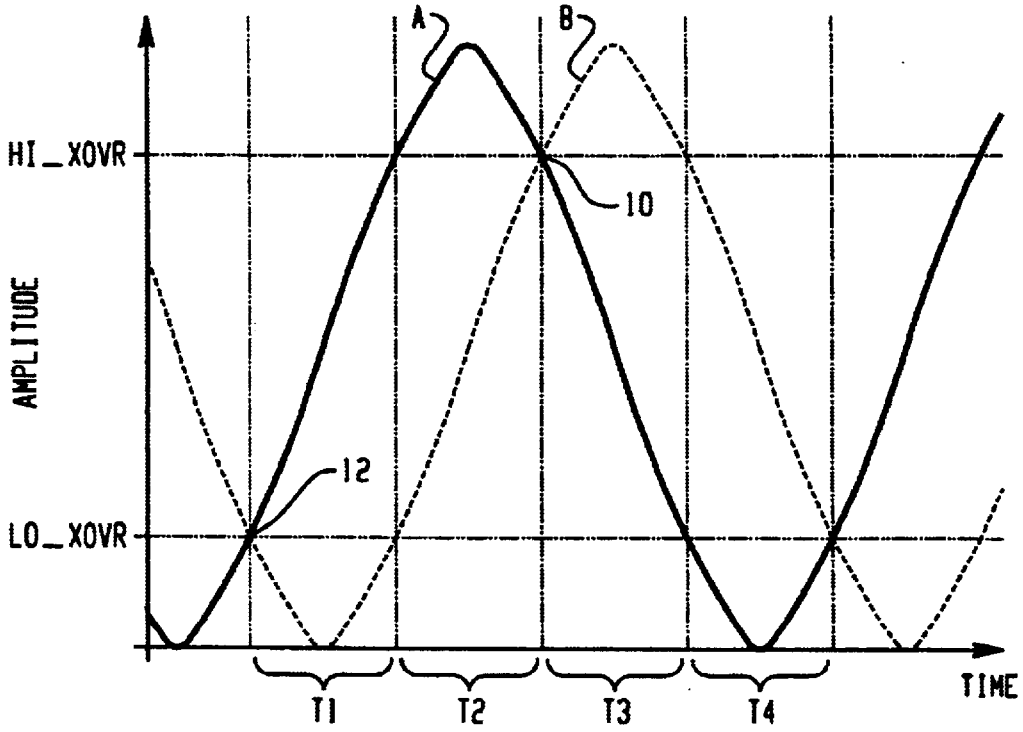
FIG. 1 illustrates two encoder output signals of an encoder.

Referring to FIG. 1, two typical analog encoder output signals A and B are shown. Each encoder output signal is produced by a respective channel or output of an encoder to be described in more detail below. The encoder output signals A and B vary in amplitude and have a period which varies with a speed of movement of a structure being monitored by the encoder. The signals could be produced by linear or rotary type encoders. Ideally the encoder output signals would be triangle waveforms, but in practice the max and min regions of each of the encoder output signals are often distorted resulting in rounded off triangle waveforms as shown. Each encoder output signal may typically be substantially linear when between an upper intersection amplitude Hi_XOVR and a lower intersection amplitude LO_XOVR, where Hi_XOVR approximates the upper amplitude where the A and B signals intersect such as at point 10 and LO_XOVR approximates the lower amplitude where the A and B signals intersect such as at point 12. As used herein the terminology "substantially linear" does not require absolute linearity.

In one embodiment, a method of tracking the movement of a structure associated with the analog encoder producing A and B encoder signals involves tracking movement of the structure based upon one or the other of signals A and B at any given time. In particular, during periods T1 and T3, when an amplitude of the A signal is within a range defined by HI_XOVR and LO_XOVR and an amplitude of the B signal is outside the range, the A signal is monitored. During periods T2 and T4, when the amplitude of the B signal is within the range defined by HI_XOVR and LO_XOVR and the amplitude of the A signal is outside the range, the B signal is monitored.

Figure 2:
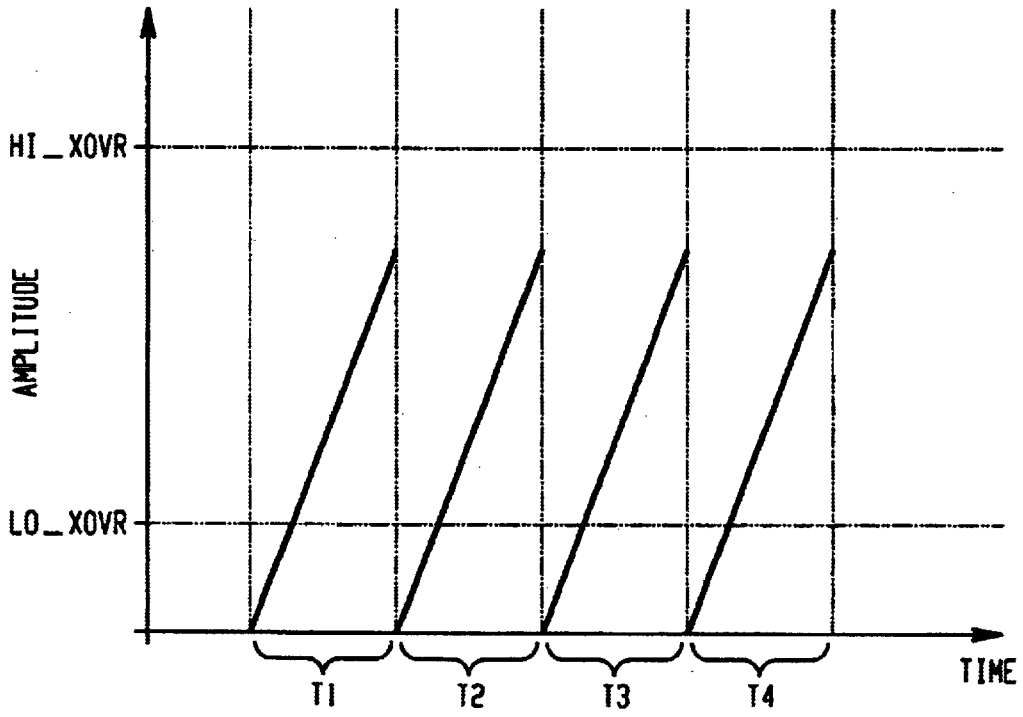
FIG. 2 illustrates one embodiment of fine position tracking for each period or cycle segment.
Figure 3:
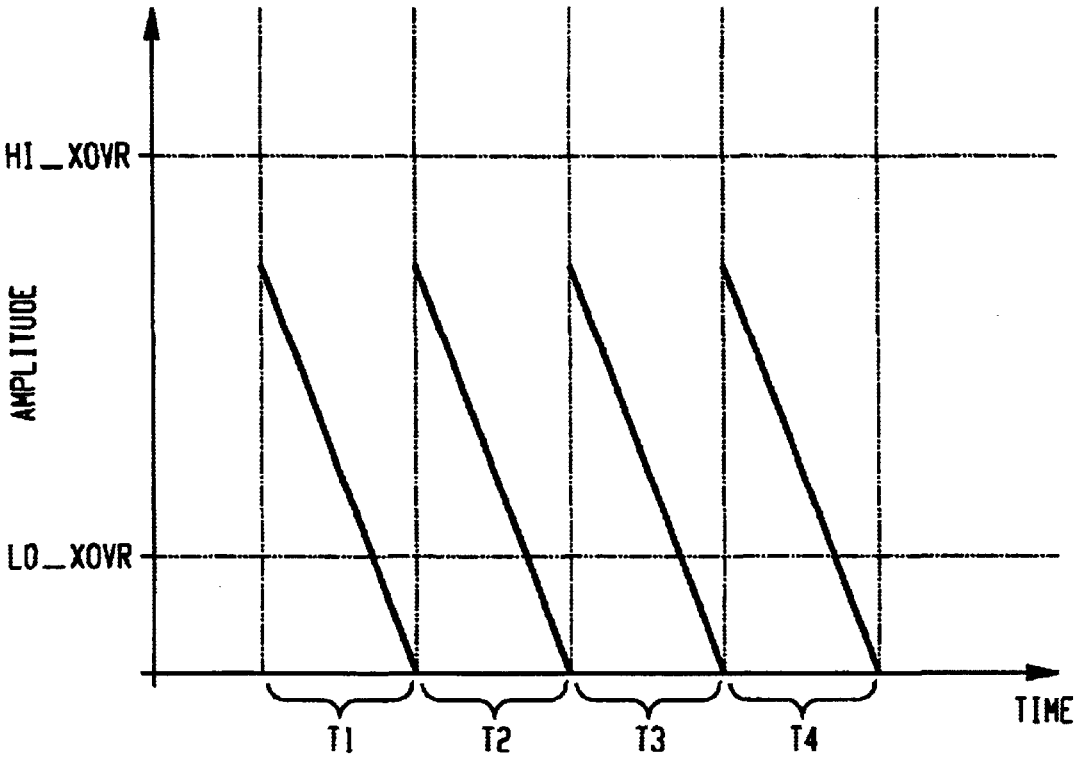
FIG. 3 illustrates another embodiment of fine position tracking for each the periods.

In one embodiment, during period T1 position of the structure is tracked as a function of the amplitude of the A signal minus the lower intersection amplitude LO_XOVR. During period T2 position of the structure is tracked as a function of the amplitude of the B signal minus the lower intersection amplitude LO_XOVR. During period T3 position of the structure is tracked as a function of the upper intersection amplitude HI_XOVR minus the amplitude of the A signal. During period T4 position of the structure is tracked as a function of the upper intersection amplitude HI_XOVR minus the amplitude of the B signal. The resulting fine position for each period T1, T2, T3 and T4 is illustrated in FIG. 2 and provides a fine position signal which increases in amplitude during each of the periods as the encoder moves in a defined forward direction (signals from left to right in FIGS. 1 and 2). Of course, variations on the exact calculation made to track fine position are possible. For example, and as reflected in FIG. 3, in another embodiment calculations could be made to produce fine position signals which decrease in amplitude as the encoder moves in the forward direction, with the system configured to properly interpret the decreasing amplitude fine position signals as encoder movement in a forward direction. In such an embodiment, during periods T1 and T2 the position would be determined as a function of the upper intersection amplitude minus the amplitude of the signal being tracked and during periods T3 and T4 position would be determined as a function of the amplitude of the signal being tracked minus the lower intersection amplitude. While the embodiments of FIGS. 2 and 3 may be considered desirable from the standpoint that in each embodiment the amplitude of the fine position signal always varies in the same direction during the periods T1, T2, T3 and T4 if the encoder maintains its same direction of movement, it is recognized that still other variations are possible. By way of example and not by way of limitation, fine position might be calculated to produce, for forward direction of the encoder, a fine position value or signal which increases in amplitude during periods T1 and T3 and decreases in amplitude during periods T2 and T4.

In addition to fine position, a coarse position regarding movement of a structure can also be tracked. The coarse position may be defined by the number of times a given one of the signals A or B crosses over one of the intersection amplitudes HI_XOVR or LO_XOVR, thus by the number of times the particular signal being tracked crosses over the one of the intersection amplitudes. By maintaining a running count of this number, coarse position is tracked. The running count can be incremented if the crossover occurs while the encoder is moving in a forward direction and could be decremented if the crossover occurs while the encoder is moving in a reverse direction. Between each of the coarse position increments fine position is tracked in accordance with the above description for each period T1, T2, T3 and T4. Periods T1, T2, T3 and T4 also define cycle segments for a given cycle of the A and B signals. Coarse position tracking can also be termed a function of the number of cycle segments which have passed.

The above are representative position or movement tracking methods in which tracking is achieved by switching back and forth between monitoring of A and B signals of an encoder when upper and lower intersection amplitudes are crossed. Other position or movement tracking methods in which switching back and forth between monitoring of the A and B signals occurs on some other basis could be developed. Regardless of the basis for switching back and forth, one commonality of many such systems will be that when monitoring, for example, the A signal, the system will not be concerned with whether the B signal actually tracks its ideal. Similarly, when monitoring, for example, the B signal the system will not be concerned with whether the A signal tracks its ideal. This fact facilitates the ability of using the encoder energization level to produce desired encoder output signals as will be described below.

In particular, the encoder can be controlled such that during monitoring of the first encoder output signal, energizing an encoder light element at a first energization level occurs and during monitoring of the second encoder output signal, energizing the encoder light element at a second energization level, which is different than the first energization level, occurs. In this manner each signal may more closely match a desired or acceptable signal at least while it is being monitored, and the need for expensive gain control circuitry for each channel on the photo sensor side of an encoder in order to achieve the desired A and B signals can also be reduced.

Figure 4:
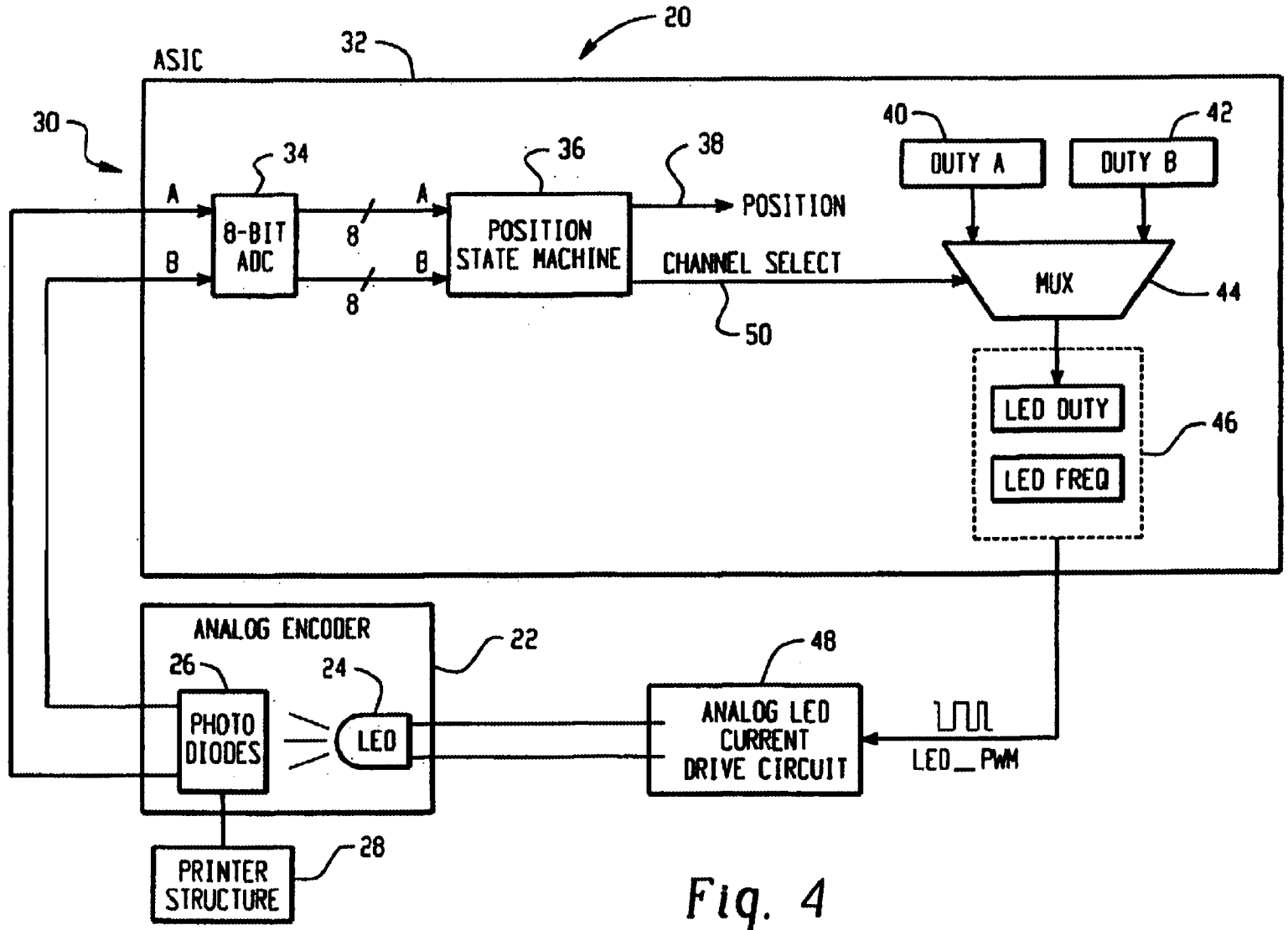
FIG. 4 is a schematic of one embodiment of an analog encoder system.

Referring now to the schematic diagram of FIG. 4, one embodiment of an analog encoder system 20 for implementing the above encoder control method is shown. The system includes an analog encoder 22 including a light element 24 such as an LED and photo sensors 26 which may take the form of photo diodes. In the case of a rotary encoder a rotating, windowed mask may be positioned between the light element 24 and photo sensors 26. In the case of a linear encoder the light element 24 and photo sensors 26 may move relative to a fixed, windowed encoder mask strip. While it is contemplated that encoder 22 may have a reduced need for costly gain and offset circuitry for each channel, it is contemplated that such circuitry (not shown) may still form a part of the encoder 22 without departing from the invention. A structure 28 such as a rotating printer feed roller or a reciprocating print head carriage mounted for movement across a paper path is associated with the encoder 22 as is commonly known in the art. The encoder 22 includes A and B outputs providing the A and B output signals to a controller 30. The controller implements the encoder control method. In the illustrated embodiment the controller 30 includes an ASIC 32 with an A/D converter 34 receiving the analog A and B signals of the encoder 22. The A/D converter 34 outputs the converted A and B signals to a position state machine 36. The position state machine 36 includes a position output 38 which may feed another control mechanism which controls movement of the printer structure 28 and may also feed other control components of a printer such as those which control the timing of printing.

The controller 30 also includes stored duty cycles Duty A and Duty B which may be stored in registers 40 and 42. These duty cycles correspond to desired energization levels for the light element 24 of the encoder 22. Each of the duty cycles is provided to a multiplexer 44 which in turn provides its output to a PWM module 46. The PWM module 46 uses the duty cycle received from the multiplexer 44 (LED Duty) in combination with a specified frequency (LED Freq) to output a PWM signal (LED_PWM) to a current drive circuit 48 which energizes the light element 24. When the output PWM signal (LED_PWM) changes, the circuit 48 correspondingly changes the energization level of light element 24. The multiplexer 44 is controlled by a channel select output 50 of the position state machine 36 to establish which duty cycle value, Duty A or Duty B, is used for energization of the light element 24. For example, during monitoring of the A signal the channel select output is set to pass the Duty A value to the PWM module 46 and during monitoring of the B signal the channel select output is set to pass the Duty B value to the PWM module 46. The Duty A and Duty B values can be determined by testing of the particular encoder system during manufacture and then storing the values. The encoder system 20 may also be occasionally automatically reinitialized to select and store new energization values in order to account for any changes in system components which may have occurred.

Figure 5A:
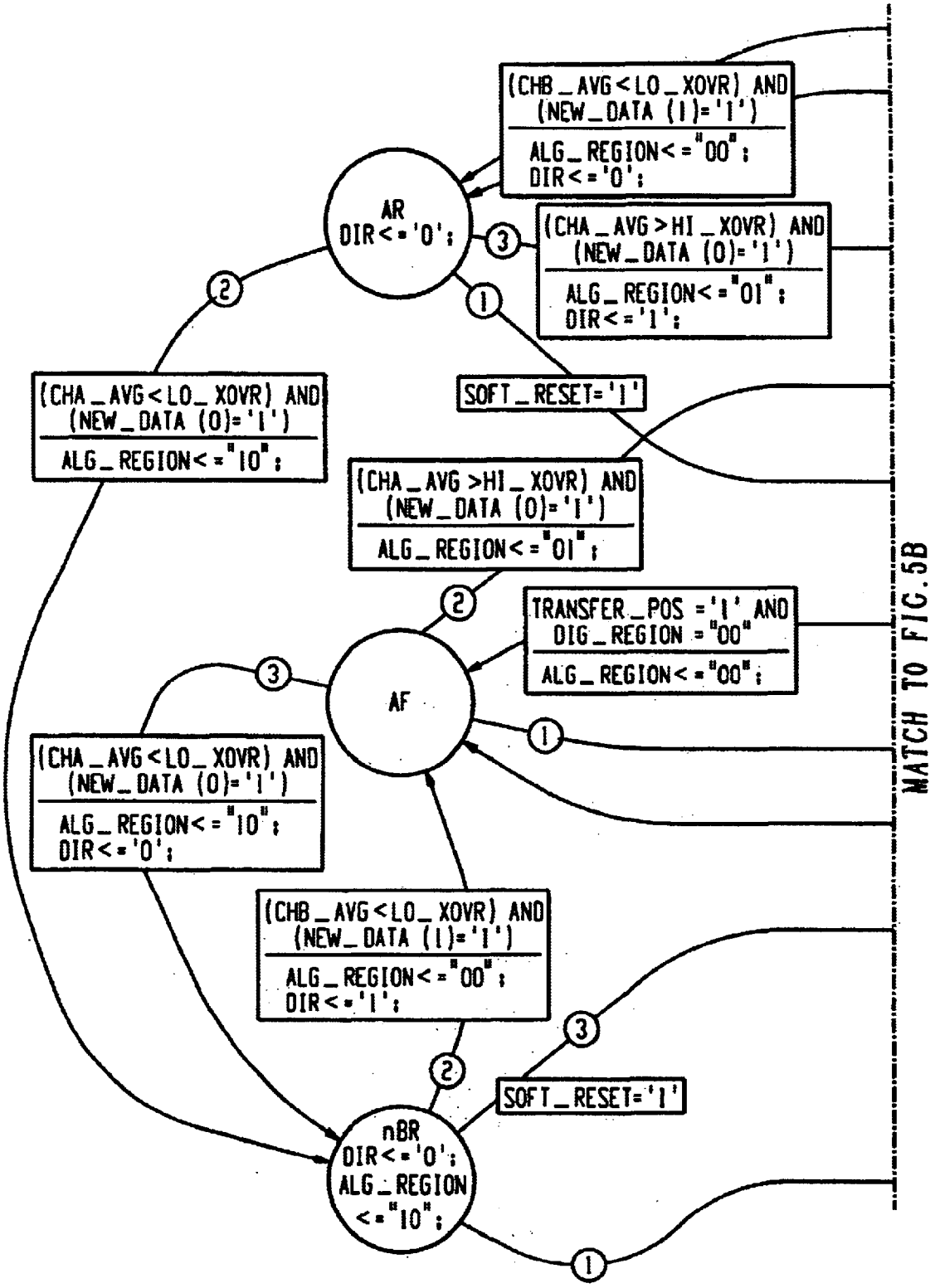
FIG. 5 is a state diagram of the state machine of FIG. 4.
Figure 5B:
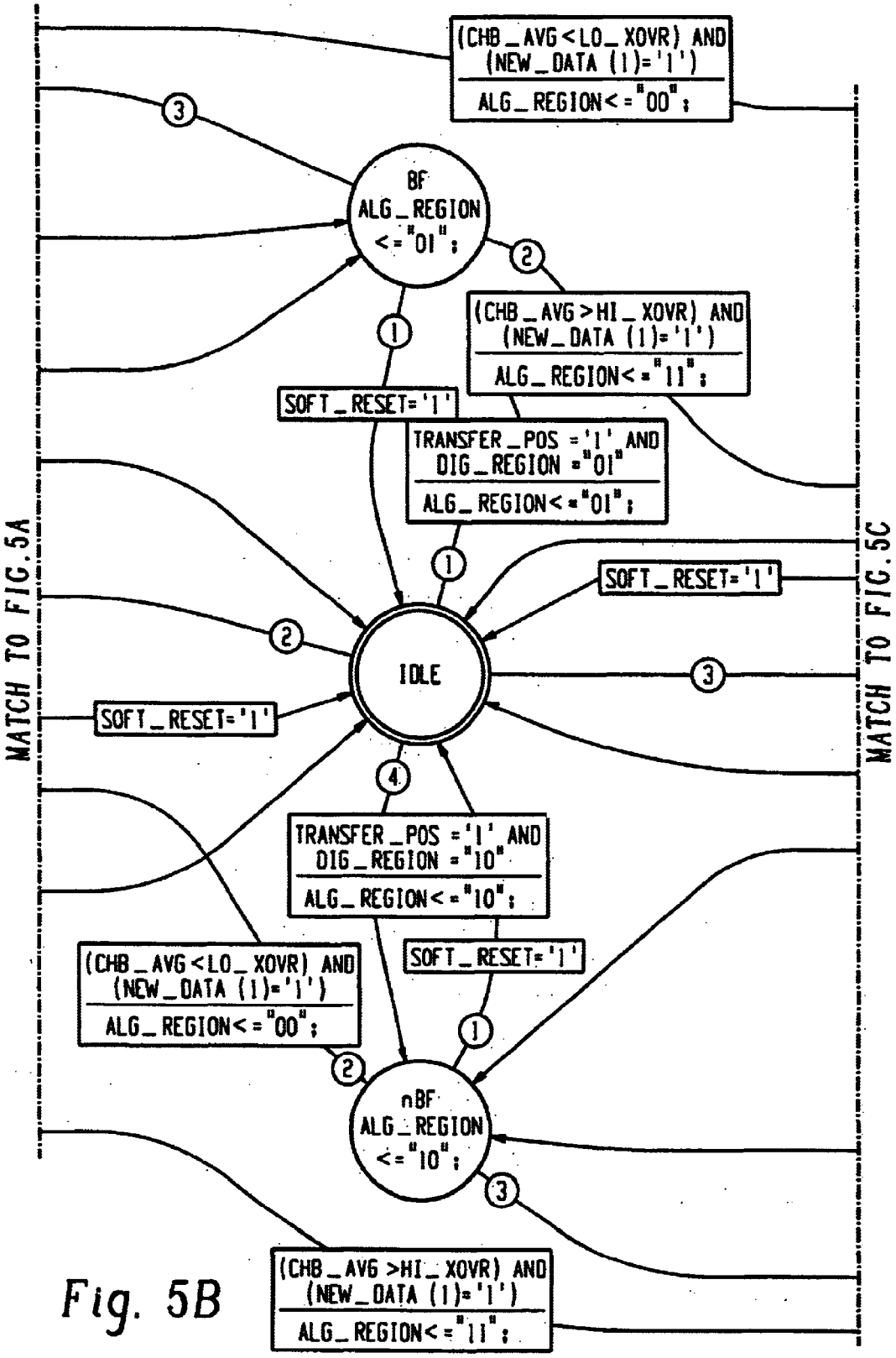
Figure 5C:
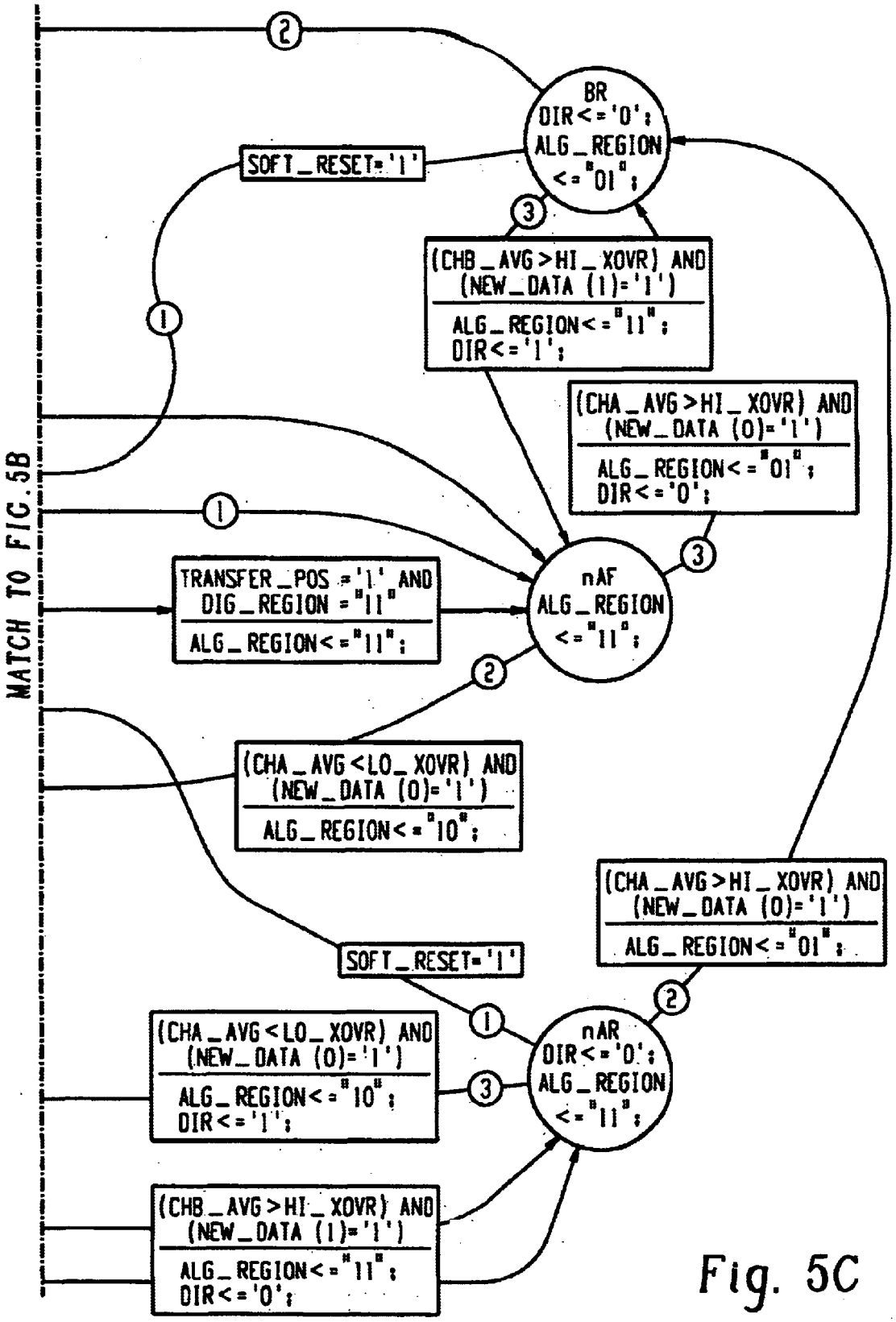

An exemplary state diagram for one embodiment of the state machine 36 is shown in FIG. 5. Nine states are shown, namely states AF, BF, nAF, nBF, AR, BR, nBR, nAR and IDLE. Relative to FIG. 1, state AF corresponds to cycle segment T1 with the encoder moving in the forward direction (signals from left to right in FIG. 1); state BF corresponds to cycle segment T2 with the encoder moving in a forward direction; state nAF corresponds to cycle segment T3 with the encoder moving in a forward direction; state nBF corresponds to cycle segment T4 with the encoder moving in a forward direction; state AR corresponds to cycle segment T1 with the encoder moving in the reverse direction (signals from right to left in FIG. 1); state BR corresponds to cycle segment T2 with the encoder moving in a reverse direction; state nAR corresponds to cycle segment T3 with the encoder moving in a reverse direction; state nBR corresponds to cycle segment T4 with the encoder moving in a reverse direction; and state IDLE corresponds to a state during which the position state machine 38 is not being used. For purposes of this discussion the IDLE state can be disregarded.

Examining an exemplary state machine progression during forward encoder movement, and assuming an initial cycle segment of T1, the state machine 36 begins in state AF. In this discussion NEW_DATA(0) corresponds to an output of the A/D converter 34 which is temporarily set to 1 each time new data for the A signal is placed on the A output. Similarly, NEW_DATA(1) corresponds to an output of the A/D converter 34 which is temporarily set to 1 each time new data for the B signal is placed on the B output.

During state AF the channel select output 50 of the state machine 36 is set to pass Duty A to the PWM module 46 and the state machine 36 tracks position or movement as a function of the amplitude of the A encoder signal until the A signal (CHA_AVG) goes above the upper intersection amplitude HI_XOVR and NEW_DATA(0) is set to 1. At that time ALG_REGION is set to binary "01" to indicate the T2 cycle segment, the channel select output 50 is switched to pass Duty B to the PWM module 46 and the state machine then moves to state BF. In state BF the state machine begins examining the B signal (CHB_AVG). When the B signal goes above upper intersection amplitude HI_XOVR and NEW_DATA(1) is set to 1, the state machine 36 sets ALG_REGION to binary "11" to indicate the T3 cycle segment, the channel select output 50 is switched to pass Duty A to the PWM module 46 and the state machine moves to state nAF. In state nAF the state machine again begins examining the A signal. When the A signal (CHA_AVG) goes below lower intersection amplitude LO_XOVR and NEW_DATA(0) is set to 1, the state machine 36 sets ALG_REGION to binary "10" to indicate cycle segment T4, the channel select output 50 is switched to pass Duty B to the PWM module 46 and the state machine moves to state nBF. In state nBF the state machine again begins examining the B signal. When the B signal (CHB_AVG) goes below the lower intersection amplitude LOW_XOVR and NEW_DATA(1) is set high, the state machine 36 sets ALG_REGION to binary "00" to indicate the T1 cycle segment, the channel select output 50 is switched to pass Duty A to the PWM module 46, and the state machine moves back to state AF. The AF to BF to nAF to nBF state sequence repeats as long as the encoder continues in the forward direction.

In the reverse encoder direction the state sequence is AR to nBR to nAR to BR. As shown, in state AR the A signal is examined to determine when to proceed to state nBR, namely when the A signal goes below the lower intersection amplitude LOW_XOVR. In state nBR the B signal is examined to determine when to move to state nAR, namely when the B signal goes above the upper intersection amplitude HI_XOVR. In state nAR the A signal is examined to determine when to proceed to state BR, namely when the A signal goes above the upper intersection amplitude HI_XOVR. In state BR the B signal is examined to determine when to proceed to state AR, namely when the B signal goes below the lower intersection amplitude LO_XOVR. During each of the reverse states the channel select output is appropriately set to pass Duty A when the A signal is being examined and to pass Duty B when the B signal is being examined.

In any one of the forward or reverse states, the state machine 36 also monitors for a change in direction of the encoder. By way of example, in state AF if the A signal goes below the lower intersection amplitude the state machine 36 sets ALG_REGION to binary "10" to indicate the T4 cycle segment and moves to state nBR. Similarly, in state nBR if the B signal moves below the lower intersection amplitude LO_XOVR the state machine sets ALG_REGION to binary "00" to indicate the T1 cycle segment and the state machine moves to state AF. The state machine can make a similar move from each of the other forward states to a next reverse state, and visa-versa, in the event of a change in direction of the encoder.

Although the invention has been described above in detail referencing the illustrated embodiments thereof, it is recognized that various changes and modifications could be made without departing from the spirit and scope of the invention.

What is claimed is:

1. In a system including an encoder having a single light source and first and second encoder channel outputs, the first encoder channel producing a first encoder output signal that varies in accordance with light received from the single light source, the second encoder channel producing a second encoder output signal that also varies in accordance with light received from the single light source, the encoder associated with a structure such that the first and second encoder output signals vary as the structure moves, a method for tracking movement of the structure using the first and second encoder output signals, the method comprising the steps of:

(a) monitoring only one of the first and second encoder output signals at a time;

(b) during monitoring of the first encoder output signal, energizing the single light source at a first energization level;

(c) during monitoring of the second encoder output signal, energizing the single light source at a second energization level which is different than the first energization level.

2. The method of claim 1 wherein the first energization level is defined by a first PWM duty cycle and the second energization level is defined by a second PWM duty cycle.

3. The method of claim 2 wherein the first PWM duty cycle and the second PWM duty cycle are each input to a multiplexer, and an output of the multiplexer is operatively connected to a current drive circuit of the single light source.

4. The method of claim 3 wherein a position state machine controls the multiplexer and also provides a position output signal.

5. A method for tracking movement of a structure using first and second encoder output signals produced by respective channels of an encoder that includes a light source, the first and second encoder output signals varying according to an energization level of an encoder light element, the method comprising the steps of:

(a) monitoring only one of the first and second encoder output signals at a time;

(b) storing first and second energization levels for use in energizing the encoder light element;

(c) during monitoring of the first encoder output signal, energizing the encoder light element according to the first stored energization level; and (d) during monitoring of the second encoder output signal, energizing the encoder light element according to the second stored energization level.

6. The method of claim 5 wherein the first stored energization level is different than the second stored energization level.

7. The method of claim 5 wherein the first stored energization level and the second stored energization level are PWM duty cycle values.

8. A method for controlling an encoder in a position tracking system in which first and second encoder output signals are produced by respective channels of the encoder, the first and second encoder output signals varying according to an energization level of an encoder light element, and only one of the first and second encoder output signals is monitored at any given time, the method comprising the steps of:

(a) during monitoring of the first encoder output signal, energizing the encoder light element at a first energization level;

(b) during monitoring of the second encoder output signal, energizing the encoder light element at a second energization level which is different than the first energization level.

9. The method of claim 8 wherein the first energization level is defined by a first PWM duty cycle and the second energization level is defined by a second PWM duty cycle.

10. The method of claim 9 wherein the first PWM duty cycle and the second PWM duty cycle are each input to a multiplexer, and an output of the multiplexer is operatively connected to a current drive circuit of the encoder light element.

11. The method of claim 10 wherein a position state machine controls the multiplexer and also provides a position output signal.

12. An encoder system for tracking movement of a structure, the system comprising:

a light element emitting light when energized;

a firsts channel output for producing a first encoder output signal as function of light received by a first photo sensor;

a second channel output for producing a second encoder output signal as a function of light received by a second photo sensor;

a controller repeatedly switching back and forth between monitoring of the first encoder output signal and monitoring of the second encoder output signal, the controller operatively connected to control an energization level of the light element, the controller setting an energization level of the light element at a first level when monitoring the first encoder output signal, the encoder setting the energization level of the light element at a second level when monitoring the second encoder output signal, the first level being different than the second level.

13. The system of claim 12 wherein the controller stores the first level and the second level.

14. The system of claim 13 wherein the controller includes a multiplexer, the first level and the second level are input to the multiplexer, and an output of the multiplexer is operatively connected to set the energization level of the light element.

15. The system of claim 14 wherein the controller includes a position state machine which is connected to control the multiplexer and which provides a position output signal.

16. The system of claim 12 wherein the first level and the second level are stored PWM duty cycles.

17. A printer including the analog encoder system of claim 12.

18. The printer of claim 17 wherein the structure is a print head carriage mounted for movement across a paper path of the printer.

19. The printer of claim 17 wherein the structure is a paper feed roller.

20. An encoder control system for use with a position tracking system in which an encoder produces first and second encoder channel output signals according to light received from a light element and movement of a structure is tracked by only monitoring one of the first and second encoder output signals at any given time, the system comprising:

a controller storing a first channel energization value for the light element and a second channel energization value for the light element, the controller setting an energization level of the light element according to the first channel energization value when the first encoder output signal is being monitored by the position tracking system, the controller setting the energization level of the light element according to the second channel energization value when the second encoder output signal is being monitored by the position tracking system.

21. The system of claim 20 wherein the first channel energization value and the second channel energization value are different.

22. The system of claim 20 wherein the controller includes a multiplexer which receives both the first channel energization value and the second channel energization value an output of the multiplexer operatively connected to a current drive circuit of the light element.

23. The system of claim 22 wherein the controller includes a position state machine which is connected to control the multiplexer.

24. The system of claim 20 wherein the first channel energization value and the second channel energization value are PWM duty cycles.

25. A printer including the encoder control system of claim 20.

26. The printer of claim 25 wherein the structure is a print head carriage mounted for movement across a paper path of the printer.

27. The printer of claim 25 wherein the structure is a paper feed roller.

* * * * *